US007740064B2

(12) United States Patent
McCoy et al.

(10) Patent No.: US 7,740,064 B2
(45) Date of Patent: Jun. 22, 2010

(54) SYSTEM, METHOD, AND APPARATUS FOR DOWNHOLE SUBMERSIBLE PUMP HAVING FIBER OPTIC COMMUNICATIONS

(75) Inventors: Robert McCoy, Talala, OK (US); Gordon Besser, Claremore, OK (US); Alan Reynolds, Carrsville, VA (US)

(73) Assignee: Baker Hughes Incorporated, Houston, TX (US)

( * ) Notice: Subject to any disclaimer, the term of this patent is extended or adjusted under 35 U.S.C. 154(b) by 403 days.

(21) Appl. No.: 11/440,307

(22) Filed: May 24, 2006

(65) Prior Publication Data

US 2007/0272406 A1 Nov. 29, 2007

(51) Int. Cl.
*E21B 47/06* (2006.01)

(52) U.S. Cl. ..... 166/250.01; 166/66; 166/66.4; 310/68 C

(58) Field of Classification Search ..... 166/105, 166/68.5, 66, 369, 250.07, 250.15, 250.01, 166/66.4; 73/152.52, 152.18; 385/12, 13, 385/37; 250/227.11; 310/71, 68 C, 87
See application file for complete search history.

(56) References Cited

U.S. PATENT DOCUMENTS 5,892,860 A 4/1999 Maron et al.
6,167,965 B1 1/2001 Bearden et al.
6,404,961 B1 6/2002 Bonja et al.
6,531,694 B2 * 3/2003 Tubel et al. ..... 250/227.14
6,787,758 B2 9/2004 Tubel et al.
6,828,547 B2 12/2004 Tubel et al.
6,913,079 B2 7/2005 Tubel
6,977,267 B2 12/2005 Dhar et al.
7,208,855 B1 * 4/2007 Floyd ..... 310/71
2003/0236626 A1 * 12/2003 Schroeder et al. ..... 702/6
2004/0154390 A1 8/2004 Baustad
2008/0124020 A1 * 5/2008 Niewczas et al. ..... 385/13

FOREIGN PATENT DOCUMENTS

WO WO 2007003445 A1 * 1/2007

* cited by examiner

*Primary Examiner*—David J Bagnell
*Assistant Examiner*—Robert E Fuller
(74) *Attorney, Agent, or Firm*—Bracewell & Giuliani LLP

(57) ABSTRACT

A downhole submersible pump system, method, and apparatus utilizes fiber optic sensors and distributed temperature sensors below the submersible pump to monitor pump discharge pressure and temperature, intake pressure and temperature, and motor temperature. In addition, distributed temperature sensors are used below the pump to monitor the perforations within the well bore.

15 Claims, 3 Drawing Sheets

SYSTEM, METHOD, AND APPARATUS FOR DOWNHOLE SUBMERSIBLE PUMP HAVING FIBER OPTIC COMMUNICATIONS

BACKGROUND OF THE INVENTION

1. Technical Field

The present invention relates in general to downhole submersible pumps and, in particular, to an improved system, method, and apparatus for a downhole electrical submersible pump equipped with a fiber optic communications.

2. Description of the Related Art

Many different techniques have been used to monitor well bores during completion and production of well bores, reservoir conditions, estimating quantities of hydrocarbons, operating downhole devices in the well bores, and determining the physical condition of the well bore and downhole devices. Reservoir monitoring involves determining certain downhole parameters in producing well bores at various locations in one or more producing well bores in a field, typically over extended time periods.

Wire line tools are commonly used to obtain such measurements, which involves transporting the wire line tools to the well site, conveying the tools into the well bores, shutting down the production and making measurements over extended periods of time and processing the resultant data at the surface. Seismic methods wherein a plurality of sensors are placed on the earth's surface and a source placed at the surface or downhole are utilized to provide maps of subsurface structure. Such information is used to update prior seismic maps to monitor the reservoir or field conditions. Each of these methods is expensive. Moreover, the wire line methods occur at large time intervals and cannot provide continuous information about the well bore condition or that of the surrounding formations.

The use of permanent sensors in the well bore, such as temperature sensors, pressure sensors, accelerometers and hydrophones has been proposed to obtain continuous well bore and formation information. To obtain such measurements from the entire useful segments of each well bore, which may include multi-lateral well bores, requires using a large number of sensors. In turn, this requires a large amount of power, data acquisition equipment and relatively large space in the well bore, all of which may be impractical or prohibitively expensive.

Once the information has been obtained, it is desirable to manipulate downhole devices such as completion and production strings. Existing methods for performing such functions rely on the use of electrically operated devices with signals for their operation communicated through electrical cables. Because of the harsh operating conditions downhole, it is difficult for the electronics used in conventional downhole sensors to survive for any extended period of time.

For example, the MTBF of semiconductors is directly reduced by high temperatures. In addition, electrical cables are subject to degradation under these conditions. In addition, due to long electrical path lengths for downhole devices, cable reactance/resistance becomes significant unless large cables are used. This is difficult to do within the limited space available in production strings. In addition, due to the high reactance/resistance, power requirements also become large.

One type of configuration operates numerous downhole devices and is necessary in secondary recovery. Injection wells have been employed for many years in order to flush residual oil in a formation toward a production well and increase yield from the area. A common injection scenario is to pump steam down an injection well and into the formation which functions both to heat the oil in the formation and force its movement through the practice of steam flooding. In some cases, heating is not necessary as the residual oil is in a flowable form, however in some situations the oil is in such a viscous form that it requires heating in order to flow. Thus, by using steam one accomplishes both objectives of the injection well: to force residual oil toward the production well; and to heat any highly viscous oil deposits in order mobilize such oil to flow ahead of the flood front toward the production well.

One of the most common drawbacks of employing the method above noted with respect to injection wells is commonly identified as "breakthrough". Breakthrough occurs when a portion of the flood front reaches the production well. As happens the flood water remaining in the reservoir will generally tend to travel the path of least resistance and will follow the breakthrough channel to the production well. At this point, movement of the viscous oil ends. Precisely when and where the breakthrough will occur depends upon water/oil mobility ratio, the lithology, the porosity and permeability of the formation as well as the depth thereof. Moreover, other geologic conditions such as faults and unconformities also affect the in-situ sweep efficiency.

While careful examination of the formation by skilled geologists can yield a reasonable understanding of the characteristics thereof and therefore deduce a plausible scenario of the way the flood front will move, it has not heretofore been known to monitor precisely the location of the flood front as a whole or as individual sections thereof. By so monitoring the flood front, it is possible to direct greater or lesser flow to different areas in the reservoir, as desired, by adjustment of the volume and location of both injection and production, hence controlling overall sweep efficiency. By careful control of the flood front, it can be maintained in a controlled, non fingered profile. By avoiding premature breakthrough the flooding operation is effective for more of the total formation volume, and thus efficiency in the production of oil is improved.

In production wells, chemicals are often injected downhole to treat the producing fluids. However, it can be difficult to monitor and control such chemical injection in real time. Similarly, chemicals are typically used at the surface to treat the produced hydrocarbons (i.e., to break down emulsions) and to inhibit corrosion. Likewise, it can be difficult to monitor and control such treatment in real time. In summary, there are many different ways of monitoring parameters in a well bore, however, an improved solution would be desirable.

SUMMARY OF THE INVENTION

One embodiment of a fiber optic system, method, and apparatus for downhole submersible pumps includes a surface panel near the well head that provides a laser light source. The invention includes means for examining a well cavity from each of the discrete sensors (e.g., Fabry-Perot, Bragg-Grating, etc.) on a fiber optic cable, and/or another system capable of measuring distributed temperature sensors (DTS). In one embodiment, the fiber optic cable comprises a multi-mode fiber and/or one or more single-mode fibers. The multi-mode fiber allows for light transmission to the DTS sensor system that is generally located below the pump and motor within the well bore. This design permits the DTS to form a profile of the temperature gradients from the pump/motor down through the perforations of the well.

In one embodiment, the single-mode fiber allows light communications to sensors (e.g., Fabry-Perot) that are located, for example, above and below the pump and motor. The upper sensor monitors pressure and temperature from the tubing and/or casing transmitting the fluid to the surface. The lower sensor is fabricated into a component that is integral with the motor assembly. It monitors motor temperature, which is critical for proper electrical submersible pump (ESP) operation. The sensor's configuration allows the sensor to be placed as close as possible to the motor end turns within the motor oil. Also, as ESPs require seal sections that equalize the pressure inside and outside the motor, the pressure measured is the pressure of the well (e.g., at the seal at the motor oil depth). The sensor section that is integral with the motor supports the weight of the tubing or other supporting rods for the DTS sensor array.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figures 1, 4:
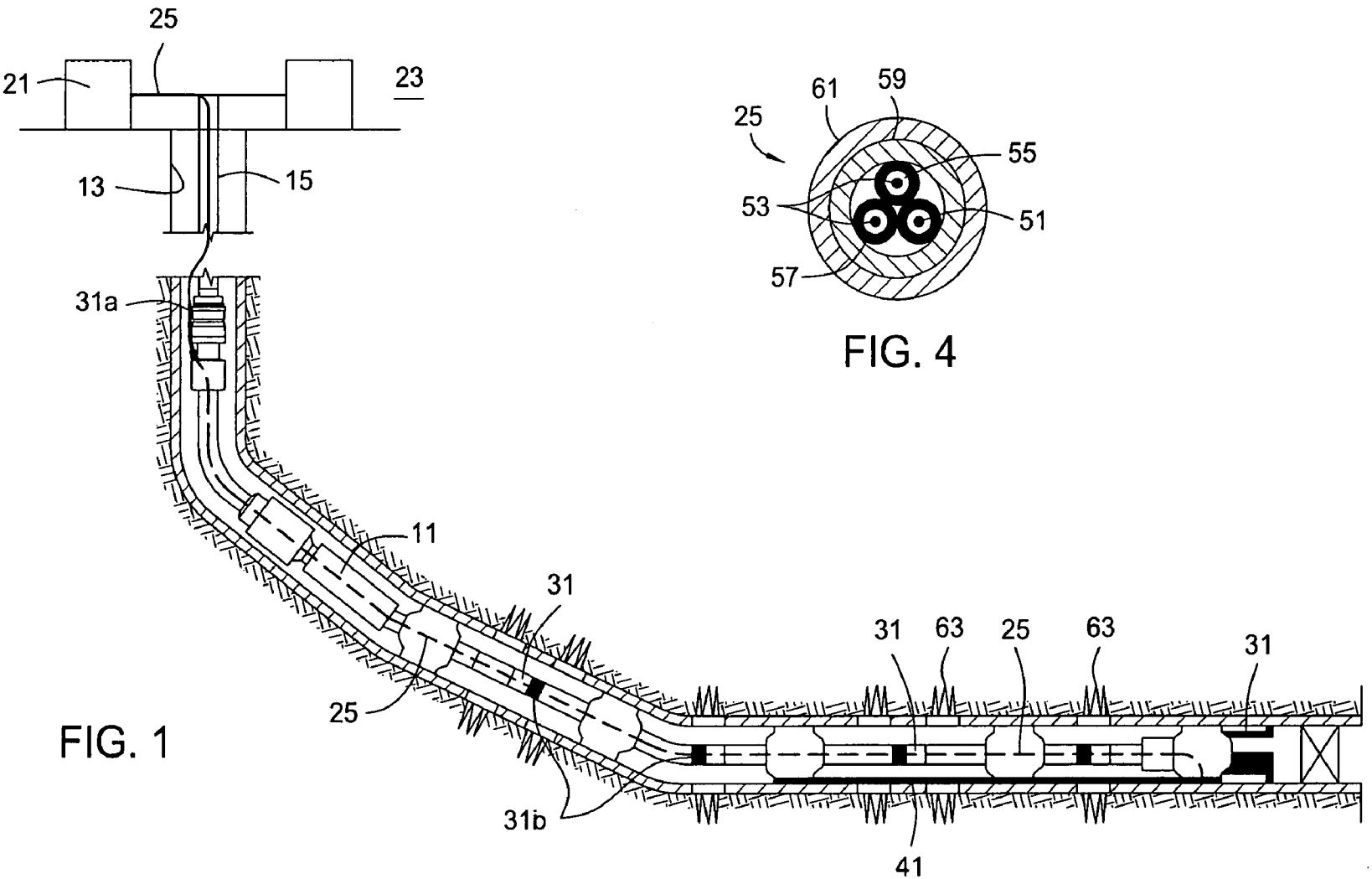
FIG. 1 is a schematic illustration of one embodiment of a downhole submersible pump system having fiber optic communications and is constructed in accordance with the present invention.
FIG. 4 is a sectional end view of one embodiment of a fiber optic cable utilized by the downhole submersible pump system of FIG. 1 and is constructed in accordance with the present invention.

Referring to FIG. 1, one embodiment of a system, method, and apparatus for providing fiber optic communications for a downhole submersible pump assembly is disclosed. The invention comprises a downhole submersible pump 11, such as a jet pump, an electrical submersible pump (ESP) having a motor, rod lift or driven pumps, gas lift pumps, or other types of pump assemblies that may be located in a well 13 on a string of tubing 15. The fiber optic system includes a surface panel 21 at the ground surface 23 of the well 13 that provides a laser light source and control of the fiber optic system. A fiber optic cable 25 extends from the surface panel 21 to the pump 11. The invention also incorporates fiber optic temperature and pressure sensors 31, at least some of which are located below the pump 11 for monitoring temperature and pressure in the well 13.

There are many different types of fiber optic temperature and pressure sensors that may be employed with the invention. For example, the fiber optic temperature and pressure sensors may comprise intrinsic sensors that are part of the fiber (e.g., fiber Bragg gratings (FBG), long period gratings (LPG), intrinsic Fabry-Perot interferometers (IFPI), etc.); and/or extrinsic sensors where sensing occurs outside the fiber (e.g., extrinsic Fabry-Perot interferometers (EFPI), intensity-based sensor designs, etc.). The sensors also may comprise point sensors having interaction lengths of, e.g., micrometers to centimeters. In still another alternative, the sensors may comprise distributed sensors, such as distributed temperature sensors (DTS) embodied in one or more fibers in the fiber optic cable and having interaction lengths of, e.g., centimeters to kilometers.

For example, sensors of the EFPI type may be used to monitor strain, temperature, and pressure and are well suited as embedment gauges. FBG sensors monitor strain and temperature, and have excellent multiplexing capability. Distributed and LPG sensors also measure multiple variables, while distributed sensors provide averages over an interaction length with Raman backscattering, OFDR, or Brillouin methods. In addition, the invention may further comprise acoustic and seismic sensors 41 for detecting vibration of the submersible pump 1*i* and vibration from sources external thereto.

As shown in FIG. 4, one embodiment of the fiber optic cable 25 comprises at least one multi-mode fiber 51 and two single-mode fibers 53. Fibers 51, 53 may be located in a gel 55 (e.g., hydrogen protective coating) inside a buffer tube 57. The three buffer tubes 57 are located inside a sleeve 59 (e.g., polypropylene), which is protected by tubing 61 (e.g., stainless steel). The multi-mode fiber 51 permits formation of, for example, a profile of temperature gradients from the pump 11 down through perforations 63 (FIG. 1) of the well 13. The single-mode fibers 53 transmit light to, for example, discrete fiber optic temperature and pressure sensors.

In one embodiment, at least one of the fiber optic temperature and pressure sensors 31 is an upper sensor 31*a* located above the pump 11, and at least one of the fiber optic temperature and pressure sensors is a lower sensor 31*b* located below the pump 11. In one embodiment, the upper sensor 31*a* monitors pressure and temperature of fluid transmitted to the surface 23, and the lower sensor 31*b* is integral with the pump 11 (e.g., the motor of the pump) and monitors motor temperature. In one embodiment, the lower sensor 31*b* is adjacent motor end turns of the motor within oil in the motor, such that pressure measured by the lower sensor 31*b* is a pressure of the well at a seal at a depth of the motor oil. In addition, the lower sensor 31*b* can support the weight of the well tubing and supporting rods for the fiber optic temperature and pressure sensors.

Figure 2:
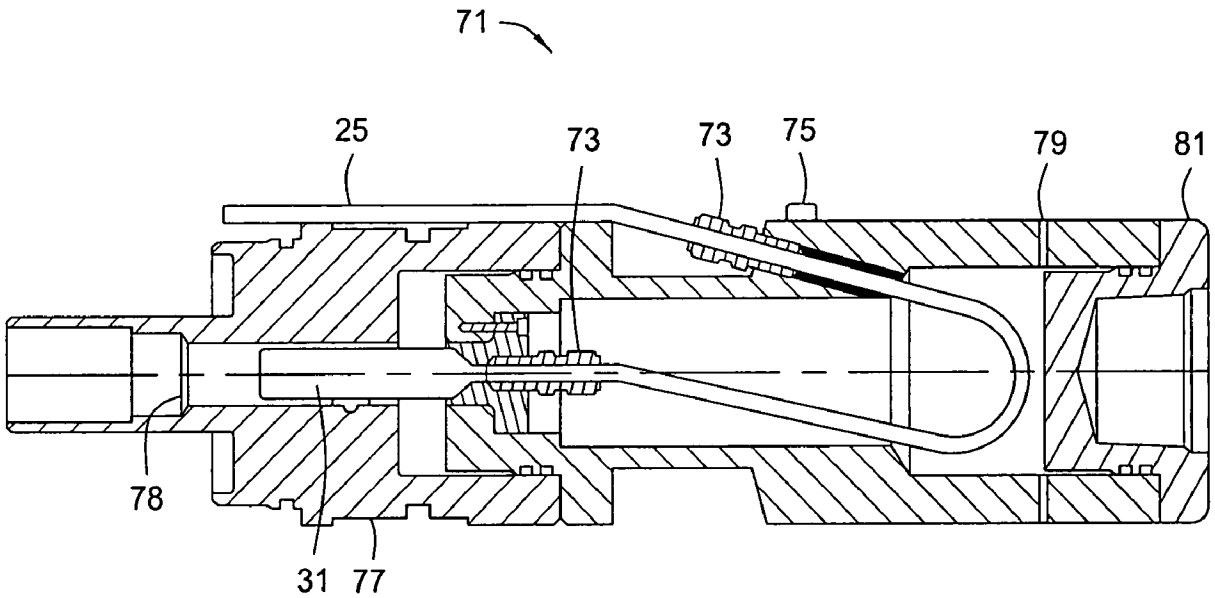
FIG. 2 is a sectional side view of one embodiment of a sensor utilized by the downhole submersible pump system of FIG. 1 and is constructed in accordance with the present invention.
Figure 3:
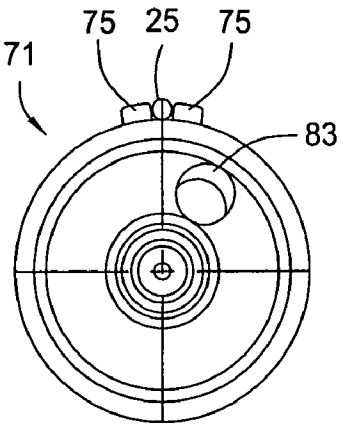
FIG. 3 is an end view of the sensor of FIG. 2 and is constructed in accordance with the present invention.

Referring now to FIGS. 2 and 3, one embodiment of a fiber optic sensor mounting sub 71 for supporting one of the sensors 31 is shown. Fittings 73 are used to secure and support the fiber optic cable 25 to the sub 71. One embodiment of the sub 71 also includes external bumper stops 75, a motor base 77 having a limit 78 of motor shaft travel, vent holes 79 to equalize pressure in the sub 71, a motor base plug 81, and an oil return path 83.

Figure 5:
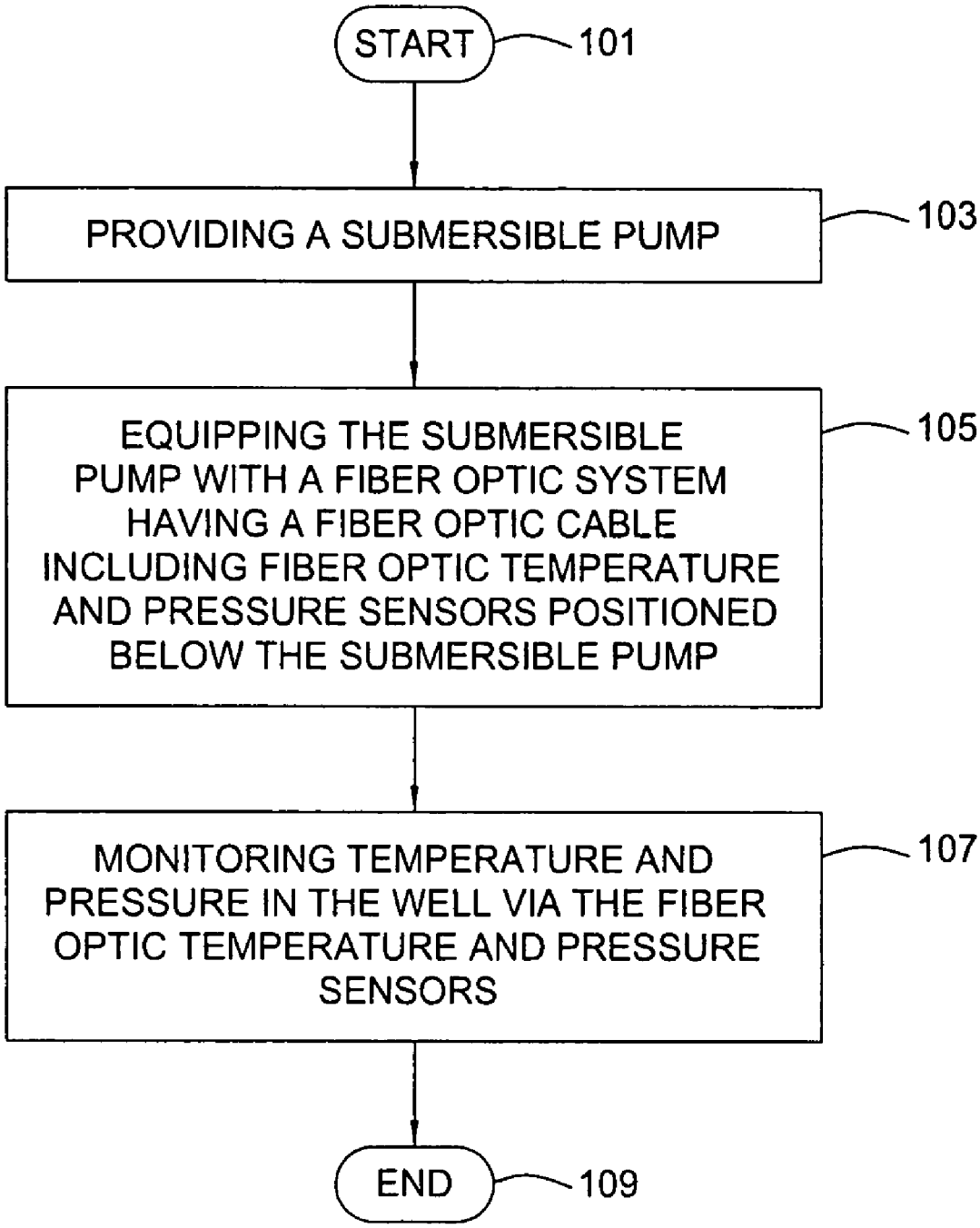
FIG. 5 is a high level flow diagram of one embodiment of a method of monitoring parameters in a well adjacent a downhole submersible pump and is constructed in accordance with the present invention.

Referring now to FIG. 5, one embodiment of a method of monitoring parameters in a well is disclosed. The illustrated embodiment of the method begins as indicated at step 101, and comprises providing a submersible pump (step 103); equipping the submersible pump with a fiber optic system having a fiber optic cable including fiber optic temperature and pressure sensors positioned below the submersible pump (step 105); and monitoring temperature and pressure in the well via the fiber optic temperature and pressure sensors (step 107); before ending as indicated at step 109.

The method may further comprise monitoring pressure with a Fabry-Perot sensor, monitoring temperature and strain with a Bragg-Grating sensor, and monitoring temperature with a distributed temperature sensor embodied in the fiber optic cable. The method also may further comprise monitoring vibration of the submersible pump and vibration from seismic sources that are external to the submersible pump with acoustic and seismic sensors. In addition, step 105 may comprise providing the fiber optic cable with a multi-mode fiber and two single-mode fibers, permitting formation of a profile of temperature gradients from the submersible pump down through perforations of the well with the multi-mode fiber, and transmitting light to discrete fiber optic temperature and pressure sensors with the single-mode fibers.

In another embodiment, the method may further comprise integrating one of the fiber optic temperature and pressure sensors with the submersible pump to monitor a temperature thereof, and further comprising locating a fiber optic temperature and pressure sensor above the submersible pump to define an upper sensor, and monitoring pressure and temperature of fluid transmitted to a surface of the well with the upper sensor. Alternatively, when the submersible pump is an electrical submersible pump (ESP) having a motor, the lower sensor is adjacent motor end turns of the motor within oil in the motor, and measuring pressure with the lower sensor at a seal at a depth of the motor oil, and supporting a weight of well tubing and supporting rods for the fiber optic temperature and pressure sensors with the lower sensor.

While the invention has been shown or described in only some of its forms, it should be apparent to those skilled in the art that it is not so limited, but is susceptible to various changes without departing from the scope of the invention.

What is claimed is:

1. A submersible pump system for monitoring parameters in a well, comprising:

an electrical submersible pump (ESP) having a motor;

a fiber optic system including a surface panel at a surface of the well having a laser light source, a fiber optic cable extending from the surface panel to the ESP;

a fiber optic sensor mounting sub mounted to a lower end of the motor, the mounting sub having an interior portion in fluid communication with motor oil contained in the motor; and at least one fiber optic sensor mounted in the mounting sub, connected to the fiber optic cable for receiving light from the surface panel, and immersed within the motor oil for sensing a parameter of the motor oil.

2. The system according to claim 1, wherein the mounting sub comprises:

an upper portion that slides within an interior portion of the motor;

a passage within the upper portion for receiving a lower end of a drive shaft of the motor, the passage being in fluid communication with the motor oil; and wherein the sensor is located within the passage below the lower end of the drive shaft.

3. The system according to claim 1, wherein the mounting sub comprises:

an upper chamber in fluid communication with the motor oil;

the sensor being located within the upper chamber a lower chamber separated from the upper chamber by a sealed barrier;

a connector in an exterior wall of the lower chamber through which the fiber optic cable enters into the lower chamber; and wherein the sensor is mounted to the sealed barrier.

4. The system according to claim 3, further comprising:

a removable plug mounted to a lower end of the lower chamber.

5. The system according to claim 4, further comprising:

a vent port in the lower chamber that admits well fluid to the lower chamber.

6. The system according to claim 3, further comprising:

a string of tubing attached to the mounting sub and extending farther into the well; and wherein a lower section of the fiber optic cable extends along the string of tubing for sensing a parameter of the well below the mounting sub.

7. The system according to claim 6, further comprising a plurality of lower fiber optic sensors connected along a length of the lower section of the fiber optic cable below the mounting sub for sensing a temperature gradient in the well.

8. The system according to claim 6, further comprising:

a plurality of lower fiber optic mounting subs mounted in and along the string of tubing; and one of the lower fiber optic sensors mounted in each of the lower fiber optic mounting subs.

9. The submersible pump system according to claim 6, wherein:

the fiber optic cable extending to the sub comprises a single-mode fiber and the lower section of fiber optic cable comprises a multi-mode fiber, and the multi-mode fiber permits formation of a profile of temperature gradients from the ESP down through perforations of the well, and the single-mode fiber transmits light to the sensor.

10. The system according to claim 1, wherein the sensor comprises a Fabry-Perot sensor for monitoring pressure of the motor oil.

11. The system according to claim 1, wherein the sensor comprises a Bragg-Grating sensor for monitoring temperature.

12. A submersible pump system for monitoring parameters in a well, comprising:

an electrical submersible pump (ESP) having a motor;

a fiber optic system including a surface panel at a surface of the well having a laser light source, and an upper fiber optic cable extending from the surface panel to the ESP;

a fiber optic sensor mounting sub mounted to a lower end of the motor;

at least one motor fiber optic sensor mounted in the mounting sub for sensing a parameter in the vicinity of the motor, the motor fiber optic sensor being connected to the upper fiber optic cable for receiving light from the surface panel;

a string of tubing attached to a lower end of the mounting sub and extending to the vicinity of perforations in the well;

a lower section of fiber optic cable extending from the mounting sub along the string of tubing to the vicinity of the perforations for determining a temperature gradient of the well;

wherein the mounting sub comprises:

an upper portion that slides within an interior portion of the motor;

a passage within the upper portion for receiving a lower end of a drive shaft of the motor, the passage being in fluid communication with motor oil in the motor; and wherein the motor fiber optic sensor is located within the passage below the lower end of the drive shaft.

13. The system according to claim 12, wherein:

the upper fiber optic cable comprises two single-mode fibers; and the lower fiber optic cable comprises a multi-mode fiber.

14. A submersible pump system for monitoring parameters in a well, comprising:

an electrical submersible pump (ESP) having a motor;

a fiber optic system including a surface panel at a surface of the well having a laser light source, and an upper fiber optic cable extending from the surface panel to the ESP;

a fiber optic sensor mounting sub mounted to a lower end of the motor;

at least one motor fiber optic sensor mounted in the mounting sub for sensing a parameter in the vicinity of the motor, the motor fiber optic sensor being connected to the upper fiber optic cable for receiving light from the surface panel;

a string of tubing attached to a lower end of the mounting sub and extending to the vicinity of perforations in the well;

a lower section of fiber optic cable extending from the mounting sub along the string of tubing to the vicinity of the perforations for determining a temperature gradient of the well;

wherein the mounting sub comprises:

an upper chamber in fluid communication with motor oil in the motor;

the motor fiber optic sensor being located within the upper chamber a lower chamber separated from the upper chamber by a sealed barrier;

an outer connector in an exterior wall of the lower chamber through which the upper fiber optic cable enters into the lower chamber; and wherein the motor fiber optic sensor is mounted to the sealed barrier.

15. The system according to claim 14, further comprising:

a vent port in the lower chamber that admits well fluid to the lower chamber.

* * * * *

UNITED STATES PATENT AND TRADEMARK OFFICE

CERTIFICATE OF CORRECTION

PATENT NO. : 7,740,064 B2
APPLICATION NO. : 11/440307
DATED : June 22, 2010
INVENTOR(S) : Robert McCoy et al.

It is certified that error appears in the above-identified patent and that said Letters Patent is hereby corrected as shown below:

Column 5, line 65, insert -- ; -- after "chamber"
Column 8, line 9, insert -- ; -- after "chamber"

Signed and Sealed this

Second Day of November, 2010

David J. Kappos

David J. Kappos
*Director of the United States Patent and Trademark Office*